US006357938B1

(12) United States Patent
Noh et al.

(10) Patent No.: US 6,357,938 B1
(45) Date of Patent: Mar. 19, 2002

(54) COATING AND DEVELOPING PROCESS SYSTEM

(75) Inventors: Hyoung-Rae Noh; Ki-Whan Shim; Hee-Young Kang, all of Chungcheongnam-do (KR)

(73) Assignee: DNS Korea Co., Ltd. (KR)

( * ) Notice: Subject to any disclaimer, the term of this patent is extended or adjusted under 35 U.S.C. 154(b) by 0 days.

(21) Appl. No.: 09/693,374

(22) Filed: Oct. 19, 2000

(30) Foreign Application Priority Data

Dec. 6, 1999 (KR) ..... 99-55231

(51) Int. Cl.[7] ..... G03D 5/00

(52) U.S. Cl. ..... 396/611; 396/627; 118/52; 118/712; 427/240

(58) Field of Search ..... 396/611, 626, 396/627; 118/52, 319, 320, 321, 500, 665, 666, 712; 427/240

(56) References Cited

U.S. PATENT DOCUMENTS 5,938,847 A * 8/1999 Akimoto et al. ..... 118/712
6,159,291 A * 12/2000 Morita et al. ..... 118/52

* cited by examiner

*Primary Examiner*—D Rutledge
(74) *Attorney, Agent, or Firm*—Marger Johnson & McCollom, P.C.

(57) ABSTRACT

A coating and developing process system is described. The system includes a chuck for mounting a substrate, at least one process solution spray nozzle for sending out coating solution and developing solution onto the substrate mounted by the chuck, a cleaning solution spray nozzle for sending out cleaning solution onto the mounted substrate, an actuator for selecting one of the process solution spray nozzle and the cleaning solution spray nozzle and then moving the selected one to a top of the substrate, and a controller for controlling the actuator. One actuator can drive the different spray nozzles, thereby saving a space and production cost of the system.

2 Claims, 2 Drawing Sheets

COATING AND DEVELOPING PROCESS SYSTEM

This application relies for priority upon Korean Patent Application No. 1999-55231, filed on Dec. 6, 1999, the contents of which are herein incorporated by reference in their entirety.

FIELD OF THE INVENTION

The present invention relates to a semiconductor process system and, more particularly, to a coating and developing process system.

BACKGROUND OF THE INVENTION

In a photolithographic process of a semiconductor device and a liquid crystal display device, a desired circuit pattern is formed by coating a resist on a semiconductor wafer and a substrate for a liquid crystal display, exposing the coated resist to light, and developing the exposed resist with a developing solution. In the developing process, a carrier gas (pressurized $N_2$ gas) is first introduced into a tank containing the developing solution. The developing solution is sent out from the tank by the gas pressure by way of a supply line to a nozzle. Finally, the developing solution is expelled from the nozzle onto the substrate. The related technique is disclosed in U.S. Pat. No. 5,866,307, entitled "RESIST PROCESSING METHOD AND RESIST PROCESSING SYSTEM", issued to Yuko Kiba et al., issued on Feb. 2, 1999.

A coating and developing process system includes a process solution spray nozzle, and a cleaning solution spray nozzle which sends out cleaning solution (e.g., ultra pure water) in order to clean an external circumferential region of a substrate. However, because the process solution spray nozzle and the cleaning solution spray nozzle are operated by respectively different drivers, the coating and developing system needs a space for installing each driver. This leads to rise a in the production cost.

SUMMARY OF THE INVENTION

Therefore, it is an object of the invention to provide a coating and developing process system of which one actuator can drive all kinds of spray nozzles.

The coating and developing process system includes a chuck for mounting a substrate, at least one process solution spray nozzle for sending out coating and develop solutions onto the substrate mounted by the chuck, a cleaning solution spray nozzle for sending out cleaning solution onto he mounted substrate, an actuator for selecting one of the nozzles and then moving the selected one to a top of the substrate, and a controller for controlling the actuator.

The coating and developing process further includes a process solution spray nozzle port in which at least one process solution spray nozzle is installed, and a carrier for carrying the port within a driving range of the actuator. The process solutions include a photoresist solution and a developing solution.

According to the coating and developing process system, one actuator can drive the different spray nozzles. Therefore, it is possible to save space and production cost with the system.

While the above advantages of the present invention have been described, other inherent advantages, objects, and uses of the present invention will become evident to those skilled in the art based on the following detailed description of the present invention with reference to the accompanying drawings.

DESCRIPTION OF THE PREFERRED EMBODIMENT

Figure 1:
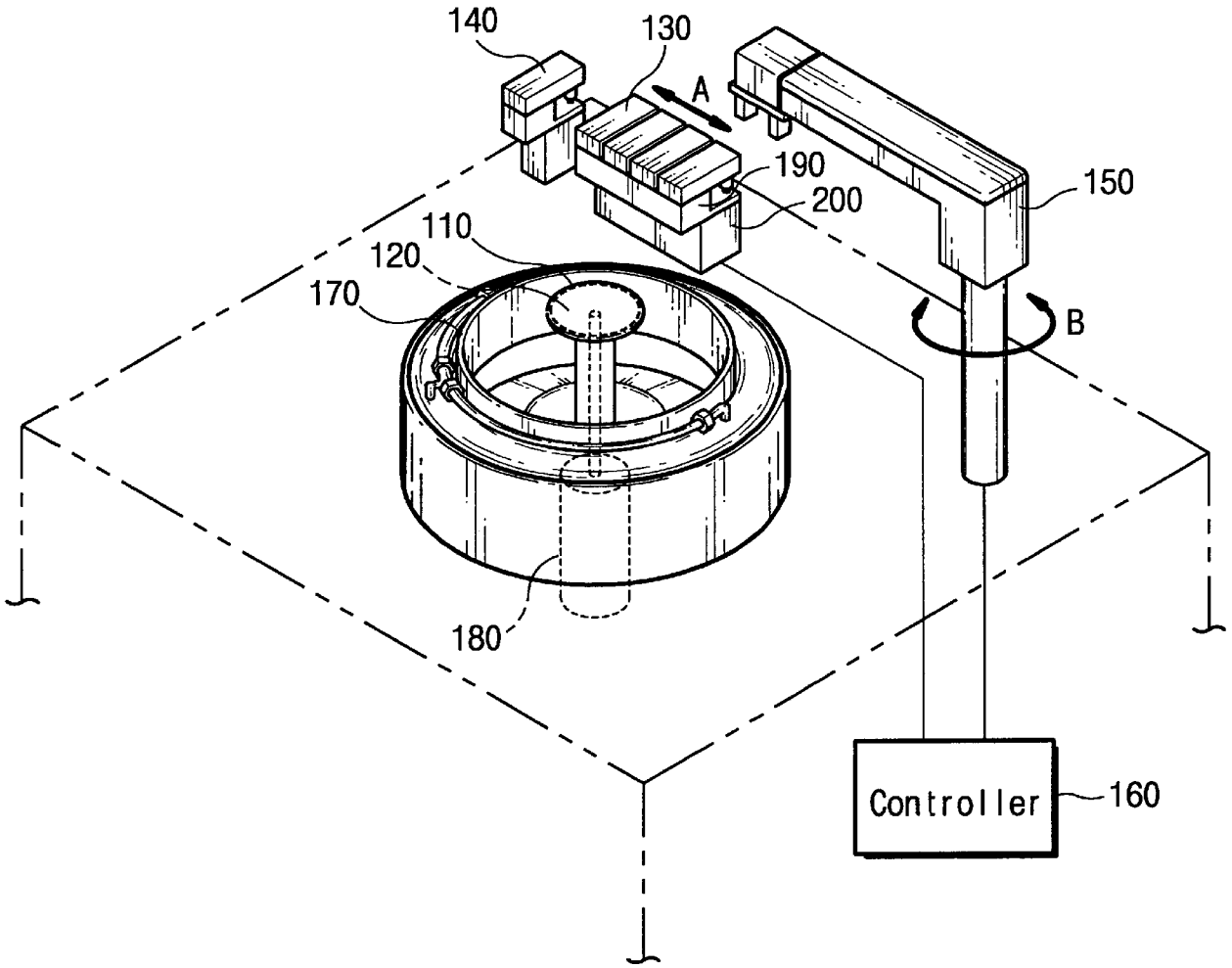
FIG. 1 is a perspective view of a coating and developing process system in accordance with one embodiment of the present invention.
Figure 2:
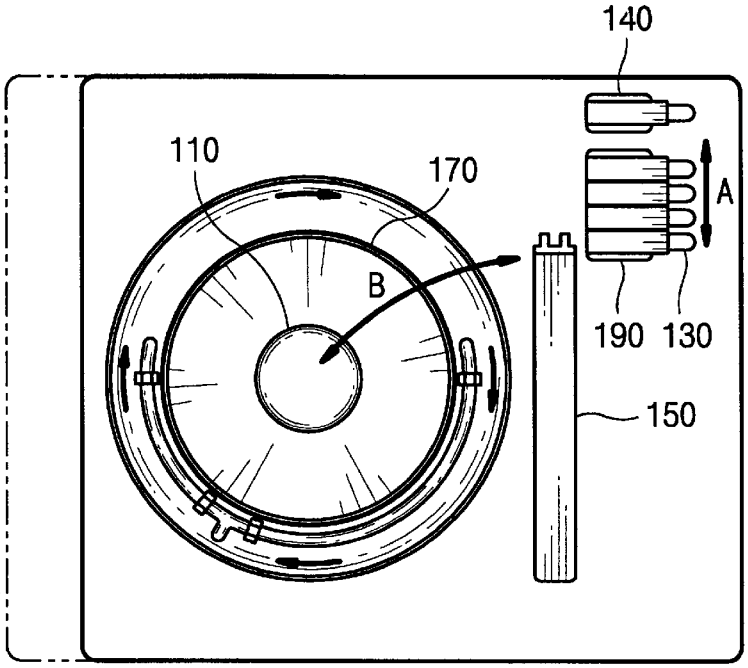
FIG. 2 is a diagram for illustrating the operating relationship of a coating and developing process system in accordance with one embodiment of the present invention.
Figure 3:
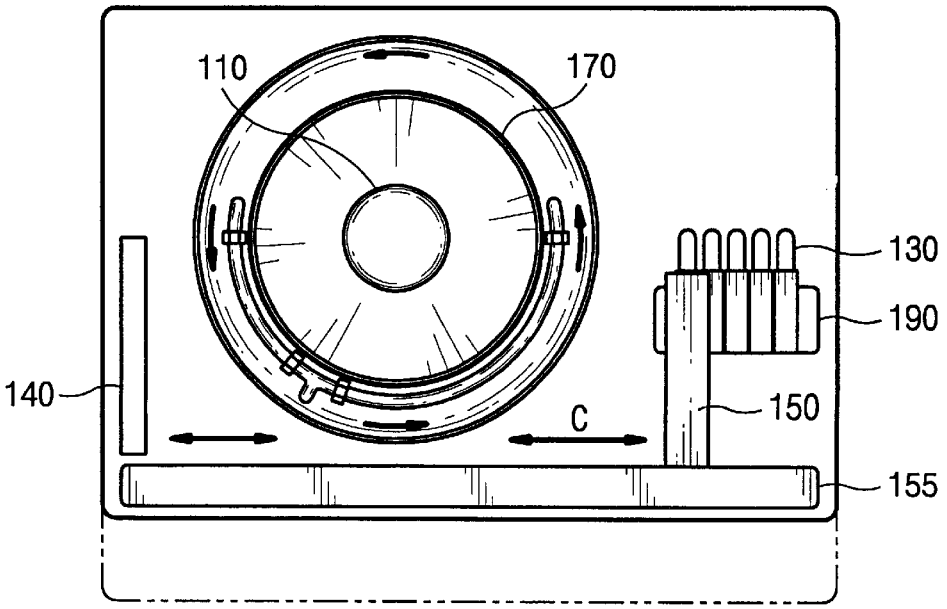
FIG. 3 is a diagram for illustrating the operating relationship of a coating and developing process system in accordance with another embodiment of the present invention.

Referring now to FIGS. 1–3, a coating and developing process system of the present invention includes a spin chuck 110, a process solution spray nozzle 130, a cleaning solution spray nozzle 140, an actuator 150, and a controller 160. The spin chuck 110 mounts a semiconductor wafer 120. A plurality of process solution spray nozzles 130 send out coating and developing process solution (e.g., photoresist solution or developing solution) onto the wafer 120 mounted by the spin chuck 110. The cleaning solution spray nozzle 140 applies cleaning solution on an edge of the mounted semiconductor wafer 120. The actuator 150 selects one of the nozzles 130 and 140, and then moves the selected one to a top of the semiconductor wafer 120. The controller 160 controls the actuator 150.

A motor 180 is coupled to a bottom of the spin chuck 110 which mounts the semiconductor wafer 120, revolving the semiconductor wafer 120. When the semiconductor wafer 120 loaded on the spin chuck 110 sends out the photoresist solution or developing solution, the solution should uniformly be applied over the semiconductor wafer 120. Because the semiconductor wafer 120 is revolved to make the solution streamed down, the chuck is contained in a cup 170 having a drain passage.

Now, operation of a photoresist process system will be described hereinafter in conjunction with applying the developing solution onto a semiconductor wafer.

A semiconductor wafer, which is coated with a constant thickness, is exposed by an exposure system such as a stepper (not shown). The exposed semiconductor wafer 120 is loaded on the spin chuck 110. When the wafer 120 is safely loaded thereon, a signal is transmitted from the controller 160 to the actuator 150. Thereafter, the developing solution spray nozzle 130 fitted for a process condition of a present state is selected and moved to a middle of the wafer 120. If there are plural nozzles 130 so as to be fitted for a process state, they are installed at a spray nozzle port 190 which can be moved along an arrow ("A" shown in FIG. 1) by a carrier 200. It will be appreciated by those skilled in the art that various techniques can be applied to a method for driving the port 190 by the carrier 200. In the port 190, the process solution spray nozzle 130 and the cleaning solution spray nozzle 140 are arranged along a common axis. However, the nozzles 130 and 140 may be arranged differently in the same zone. In this case, arrangement that is different from that of this embodiment may be made within the driving range of the actuator 150.

According to one embodiment, the developing solution spray nozzle 130 required in a process is moved to align with a present location of the actuator 150. The controller 160 horizontally moves the carrier 200 that holds nozzle 130 and port 190 to a specified position by transmitting a signal to the carrier 200, so that the nozzle 130 is aligned with actuator

150. Then, the actuator 150 vertically moves downward to selectively absorb the nozzle 130 using a vacuum absorption technique. The actuator 150 is revolved toward an arrow ("B" shown in FIG. 1) with a constant angle, and then is moved over the semiconductor wafer 120. The spin chuck 110 revolves the wafer 120, enabling the nozzle 130 to uniformly supply the developing solution over the wafer 120. If a resist removal process using the developing solution is completed, the cleaning spray nozzle 140 is required for cleaning an edge of the wafer 120. In this case, a series of operations for carrying the cleaning solution spray nozzle 140 over the wafer 120 are identical to the above-mentioned operations for the developing solution. That is, the carrier 200 is moved to a specified position, enabling the actuator 150 to absorb the cleaning solution spray nozzle, and then the actuator 150 is revolved and moved above the wafer 120. The wafer 120 is entirely cleaned by revolving the wafer 120 at high speed while applying ultra pure water.

As mentioned above, because only one driver (i.e., actuator) is required for driving a process solution spray nozzle and a cleaning solution spray nozzle, other drivers are not required.

According to another embodiment, there is no carrier 200. The process solution nozzle 130 and the cleaning solution spray nozzle 140 are arranged at a position where they can send out the process solution and cleaning solution, respectively. The actuator 150 is horizontally moved toward an arrow ("C" shown in FIG. 3) to simply absorb a required nozzle. In this embodiment, a supporter 155 is added for horizontally moving the actuator 150, and the cleansing solution spray nozzle 140 is separated from the process solution spray nozzle 130. Naturally, the nozzles 130 and 140 are located within the driving range of the actuator 150, and aligned on a line.

As described above, in a coating and developing process system, one actuator can drive the different spray nozzles. Therefore, it is possible to save a space and production cost of the system.

The present invention has been described and its operation detailed. When a person skilled in the art reads the foregoing description, alternatives and equivalents within the spirit and intent of the present invention will be apparent. Accordingly, it is intended that the scope of the present invention be limited by the claims that follow.

What is claimed is:

1. A coating and developing process system comprising:

a chuck for mounting a substrate;

at least one process solution spray nozzle for sending out coating solution and developing solution onto the substrate mounted by the chuck;

a cleaning solution spray nozzle for sending out cleaning solution onto the mounted substrate;

an actuator for selecting one of both the at least one process solution spray nozzle and the cleaning solution spray nozzle, and then moving the selected one to a top of the substrate; and a controller for controlling the actuator, wherein both the at least one process solution spray nozzle and the cleaning solution spray nozzle are driven by the actuator.

2. The system as claimed in claim 1 further comprising:

a process solution spray nozzle port in which the at least one process solution spray nozzle is installed; and a carrier for carrying the process solution spray nozzle port to a driving range of the actuator.

* * * * *